US008360682B2

(12) United States Patent
Xu

(10) Patent No.: US 8,360,682 B2
(45) Date of Patent: Jan. 29, 2013

(54) INFORMATION METHOD COMBINED WITH DYNAMIC CONSOLIDATION AND VACUUM DRAINAGE FOR REINFORCEMENT OF SOFT SOIL GROUND

(75) Inventor: Shilong Xu, Shanghai (CN)

(73) Assignee: Shanghai Harbour Soft Soil Treatment Engineering Co. Ltd., Shanghai (CN)

( * ) Notice: Subject to any disclaimer, the term of this patent is extended or adjusted under 35 U.S.C. 154(b) by 277 days.

(21) Appl. No.: 12/516,262

(22) PCT Filed: Jul. 30, 2007

(86) PCT No.: PCT/CN2007/002286
§ 371 (c)(1),
(2), (4) Date: May 26, 2009

(87) PCT Pub. No.: WO2008/064550
PCT Pub. Date: Jun. 5, 2008

(65) Prior Publication Data

US 2010/0061806 A1 Mar. 11, 2010

(30) Foreign Application Priority Data

Dec. 1, 2006 (CN) ..... 2006 1 0119014

(51) Int. Cl.
*E02D 3/10* (2006.01)

(52) U.S. Cl. ..... 405/128.2; 210/170.07

(58) Field of Classification Search ..... 405/128.2, 405/128.3; 210/170.07
See application file for complete search history.

(56) References Cited

U.S. PATENT DOCUMENTS 4,611,950 A * 9/1986 Russomano ..... 405/128.2
5,265,978 A * 11/1993 Losack ..... 405/128.2
5,358,357 A * 10/1994 Mancini et al. ..... 405/128.2

FOREIGN PATENT DOCUMENTS

CN ZL01127046.2 1/2002
CN 1584221 2/2005
CN 1624250 6/2005
JP 2000144710 A 5/2000

OTHER PUBLICATIONS

Chen, Jianye, "reinforcement of soft soil foundation with hydraulic fill sand based on the method combined with dynamic consolidation and vacuum drainage", Shanxi Architecture, Jul. 2003, pp. 66-67, vol. 29, No. 7.
Zhong, Jianmin, et al, "ground treatment scheme with vacuum pumping and dynamic consolidation in the construction of a track field and the field test", Geotechnical Investigation & Surveying, Oct. 2003, pp. 14-18, No. 5.

* cited by examiner

*Primary Examiner* — Tara Mayo-Pinnock
(74) *Attorney, Agent, or Firm* — Rabin & Berdo, P.C.

(57) ABSTRACT

A method for treating soft soil, including dividing a site into a plurality of subsections, investigating profile of the soft soil in each of the plurality of subsections, estimating expected settlement of the soft soil in each of the plurality of subsections, installing a plurality of water-tight systems around the site to block seepage of ambient groundwater from entering the site, installing a plurality of vacuum pipes in the plurality of subsections in a layered matrix form, connecting the plurality of vacuum pipes to a vacuum system via a plurality of ground horizontal pipes, placing a piezometer in each soil stratum, probing ramming energy thereof by conducting dynamic trials, measuring pore water pressure dissipation of each soil stratum to determine the spacing of the plurality of vacuum pipes, and performing a plurality of cycles of vacuum-compactions in each of the plurality of subsections.

6 Claims, 1 Drawing Sheet

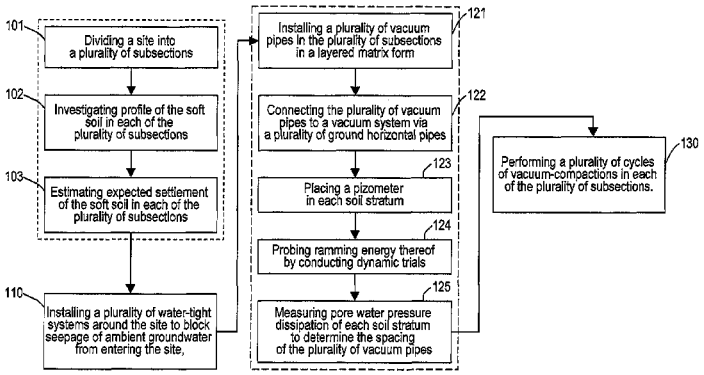

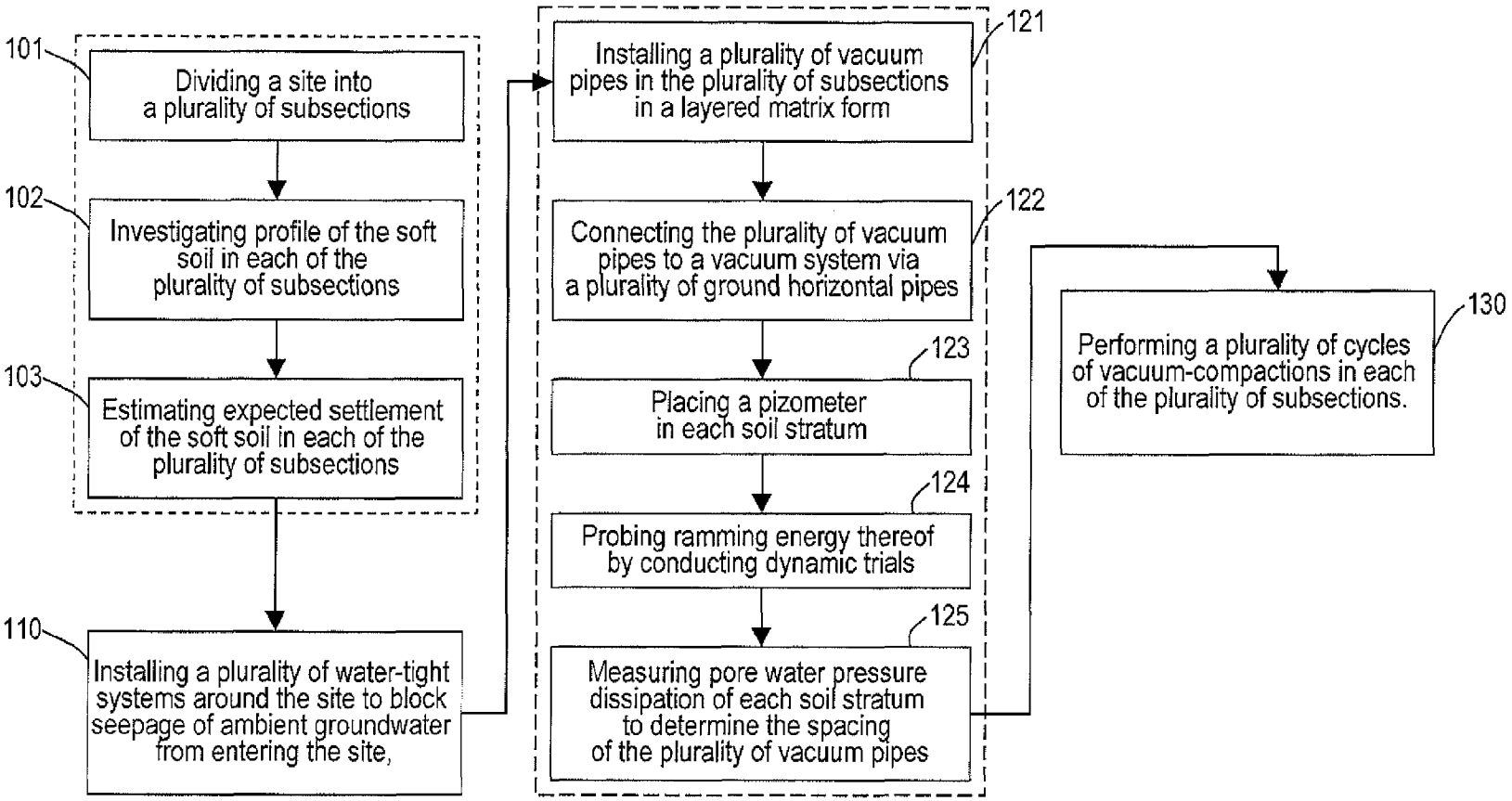
101
Dividing a site into a plurality of subsections
102
Investigating profile of the soft soil in each of the plurality of subsections
103
Estimating expected settlement of the soft soil in each of the plurality of subsections
110
Installing a plurality of water-tight systems around the site to block seepage of ambient groundwater from entering the site,
121
Installing a plurality of vacuum pipes in the plurality of subsections in a layered matrix form
122
Connecting the plurality of vacuum pipes to a vacuum system via a plurality of ground horizontal pipes
123
Placing a pizometer in each soil stratum
124
Probing ramming energy thereof by conducting dynamic trials
125
Measuring pore water pressure dissipation of each soil stratum to determine the spacing of the plurality of vacuum pipes
130
Performing a plurality of cycles of vacuum-compactions in each of the plurality of subsections.

INFORMATION METHOD COMBINED WITH DYNAMIC CONSOLIDATION AND VACUUM DRAINAGE FOR REINFORCEMENT OF SOFT SOIL GROUND

TECHNICAL FIELD

The present invention belongs to the technical field of soft soil treatment, involving a method for soft soil treatment, more particularly, to an information-based high vacuum densification method for fast treatment of soft soil.

BACKGROUND OF THE INVENTION

Due to the complexity and variation of soil conditions, soils properties change substantially between treatment subsections, where, accordingly, water contents and coefficient of permeability vary significantly. However, consistent post-treatment technical requirements are wanted between subsections. High Vacuum Densification Method (HVDM, No. ZL01127046.2) and Soft Soil Treatment Using Innovative High Vacuum and Inter-Moderated Compactions (Publication No. CN1624250A) are two fast soft soil treatment methods.

HVDM inserts vacuum pipes with layered matrix form into soils, imparts vacuum efforts, and densifies the soils using several cycles of vibrations and dynamic compactions. The goal is to decrease the soil water contents, increase the soil compactions and bearing capacities, and mitigate the post-treatment settlements. Construction flow in details is presented in CN Patent No. ZL01127046.2. Notwithstanding HVDM saves lots of time, this method has drawbacks, which have been described and resolved in Soft Soil Treatment Using Innovative High Vacuum and Inter-Moderated Compactions.

The method, Soft Soil Treatment Using Innovative High Vacuum and Inter-Moderated Compactions, treats soils based on the soil water contents and coefficient of permeability by installing vacuum pipes, imparting vacuum effort, uninstalling partial vacuum pipes and imparting vacuum-compaction efforts. Densify the site by dynamic or vibration compaction with varied energies each cycle. Several cycles of combined efforts of vacuum dewatering and inter-moderated compaction are imparted on different soils. Such manner results in decreased water contents, improved compactions and increased bearing capacities.

As partial vacuum pipes are uninstalled, the remained pipes are able to monitor the drainage volume, and thus the magnitude of pore water pressures. The pore water pressures are caused by the compaction energies. In turn, the drainage volume is able to reflect the propriety of compaction energies imparted, namely, the drainage volume of remained pipes will tail off with too high or too low energy imparted. Furthermore, the soft soils are further drained by the pressure gradient caused by the excess pore water pressure (a positive pressure) and the vacuum effort (a negative pressure). However, the following drawbacks exist.

1. As the soft soil treatment scope is vast, the soil properties vary significantly. After treatments, the soil improvements are not consistent, which may result in differential settlements, such as roads' heave-up.

2. The above methods have considered leaving partial vacuum pipes, measuring the water flow volumes and estimating the tamping energies. However, water flows of each soil layer vary significantly and can not be monitored for complicated sites. Different soil layers vary with respect to pipe spacing, vacuum duration. Such drawbacks may lead to spring or rubber soils.

3. In the above methods, groundwater may seepage into the treatment sites, which result to the less guaranteed treatment quality along the treatment boundary.

4. General soft soils are weak. In such cases, aggregates are backfilled in the top to support heavy machineries. However, cost is increased and environment is threatened.

SUMMARY OF THE INVENTION

The objectives of the present invention are to eliminate the above drawbacks and offer an information-based high vacuum densification method for fast treatment of soft soil.

The method of the present invention includes the following steps:

Step 1, divide the site into several subsections, use handy augers to investigate the soil profiles of subsections, estimate the expected settlements of subsections.

Step 2, install water-tight systems around the site and block the seepage of ambient groundwater.

Step 3, install vacuum pipes in subsections, pipes are connected to the ground horizontal pipes and vacuum systems, pizometers are placed in each soil stratum, dynamic trials are conducted to probe the ramming energies, measure the pore water pressure dissipation of each stratum and determine the vacuum pipe spacing.

Step 4, impart several cycles of high vacuum and inter-moderated compactions in subsections.

Subsurface soil consolidation is required when the subsurface soils present high water contents and low bearing capacities, which may improve the subsurface soil strength and support the loads of machineries. Accordingly, a subsurface soil consolidation procedure is implemented after Step 2 and before Step 3, e.g., vacuum pipes are installed into subsurface soils and vacuum efforts are imparted. Simultaneously, trailers are used to compact the soils, decrease the water contents and improve the bearing capacities.

To eliminate the differential settlements, information-based measurements are supplemented in Step 4, e.g., level the site using bulldozers after each vacuum-compaction effort, calculate the average settlement of each subsection, and compare the settlements with estimated values. If settlements are inadequate, impart another cycle vacuum-compaction effort till the estimated values are met.

Compared to the current HVDM soil treatment technique, the information-based high vacuum densification method for fast treatment of soft soil of the present invention offers a further saving of time and cost and improved treatment quality.

BRIEF DESCRIPTION OF DRAWINGS

FIG. 1 is a flowchart illustrating the high vacuum densification method for fast treatment of soft soil in one embodiment of the invention.

DETAILED DESCRIPTION OF THE INVENTION

Specific procedures of the information-based high vacuum densification method for fast treatment of soft soil of the present invention are presented in combination with the following examples.

The project is railways of port stack yard. Design requirements: less than 1/1000 differential settlement longitudinally, and less than 1.5/1000 differential settlement transversely.

Step 1, divide the full site into subsections (step 101 in FIG. 1). Use handy augers to investigate the soil profiles (step 102 in FIG. 1).

To prevent the lateral displacement of piles, treatment scopes were extended by 15 m each side. Accordingly, the railway treatment width was 33 m. Two railways were treated, e.g., railway A and railway B. Railway A was divided by 33×50 $m^2$ and into subsections of A1, A2 and A3 etc. Railway B was divided by 33×50 $m^2$ and into subsections of B1, B2 and B3 etc.

Using handy augers, the site soil profiles were presented below.

Top layer, 0.5-2.5 m thick, silt, water content is 50-80%; Layer 2, 2.5-10 m thick, soft silty clay; Layer 3, 10-15 m thick, silty clay.

Expected Settlement Sci (see step 103 of FIG. 1):

$$S_{ci} = \alpha\varphi_s \sum_{i=1}^{n} \frac{P_0}{E_{si}}(z_i\bar{a}_i - z_{i-1}\bar{a}_{i-1}) - [S]$$

wherein, $S_{ci}$—amount of expected settlement for ground;

α—HVDM modification coefficient (0.25~0.9);

$\phi_s$—settlement modification coefficient (1~1.9);

n—soil layer numbers within deformed depth;

$P_0$—additional pressure at the foundation base surface, corresponding to the quasi-permanent combination of load effects (kPa);

Esi—modulus of compression (MPa), of the ith stratum soil below the foundation base surface, the pressure section, from the pressure due to self-weight of soil to the summation of pressure due to self-weight of soil and additional pressure of soil, shall be taken for calculation;

$z_i$, $z_{i-1}$—distance from foundation base surface to the ith stratum soil base surface, to the i-lth stratum soil base surface (m);

$\bar{a}_i$, $\bar{a}_{i-1}$—Coefficient of average additional, within the range from the foundation base surface calculating point to the ith stratum soil base surface, to the i-lth stratum soil base surface;

[S]—Allowable post-treatment settlement.

Step 2, install water-tight systems around the site and block the seepage of ambient groundwater (step 110 in FIG. 1).

Around the site and at 2-3 m away from the railway treatment scope, install vacuum pipes of different lengths. The arrangements for short and long pipes were 1×2.5-3 m and 1×6~8 m, respectively.

While conducting compactions, apply vacuum efforts (Vacuum pipes were connected to ground horizontal pipes and vacuum systems.) onto the ambient soils to block the seepage of ambient groundwater.

Step 3, install vacuum pipes into surface soil in subsections and impart vacuum efforts. Simultaneously, trailers were used to compact the soils, decrease the water contents and improve the bearing capacities.

As there was a 2 m thick silty soil of 50-80% water content on surface, 20-30 kPa bearing capacity, and the ramming machineries was not able to access the site. The surface soils have to be consolidated to increase bearing capacity. The details are presented below.

First, Install vacuum pipes by 3×5 m (step 121 in FIG. 1). Pipes were connected to ground horizontal pipes and vacuum systems (step 122). Impart vacuum efforts for 2-3 days, and use trailers to compact the site for 1-2 cycles at the same time. Then, impart the vacuum efforts for 5-7 days when trailers were used to compact the site for 5-8 cycles each day. As a result, the water contents of surface soils were decreased and the bearing capacities were increased to 80–100 kPa.

Step 4, install vacuum pipes into different stratum in subsections. Place pizometers into each soil layer (step 123) and conduct the compaction trials (step 124). Measure the pore water pressure dissipation of each stratum and determine the vacuum pipe spacing (step 125).

To consistently improve the soil layers of different subsections and prevent the rubber soils, soil optimum water contents should be approached. Pipe spacing and vacuum duration were carefully determined. The details are presented below.

Install vacuum pipes by 3.5×6 m for surface layer, 3.5×3 m for Layer 2, and 3.5×4 m for Layer 3, respectively. Pipes were connected to ground horizontal pipes and vacuum systems. Place pizometers are placed in each layer.

Determination of optimum vacuum pipe spacing: use ramming energy of 2800 kN·m, 6-8 blows a tamper point, and 4×7 m spacing. Impart vacuum efforts for 5-7 days and monitor the pore water pressures twice a day.

The data indicated that the pore water pressure dissipation were over 85% for surface layer at day 4, over 85% for Layer 2 at day 7, and over 85% for Layer 3 at day 6.

According to the trial data, the final spacings are 3.5×8 m for surface layer, 3.5×2.5 m for Layer 2, and 3.5×4 m for Layer 3, respectively.

Furthermore, as the excess pore water pressures dissipated by 85% at day 6, the duration of imparting vacuum effort was 6 days.

Step 5, impart several cycles of high vacuum and inter-moderated compactions in subsections at 500-3500 kN·m (step 130 in FIG. 1).

Impart first cycle high vacuum and inter-moderated compaction.

After vacuuming for 6 days, uninstall vacuum pipes for Layers 1 and 2, and impart 1-1 cycle high vacuum and inter-moderated compaction. The unit ramming energy is 2800-3000 kN·m, 6-8 blows at spacing of 4×7 m.

Repeat the above construction flows, uninstall vacuum pipes for Layers 1 and 3, and impart 1-2 cycle high vacuum and inter-moderated compaction.

Repeat the above construction flows, uninstall vacuum pipes for Layers 2 and 3, and impart 1-3 cycle high vacuum and inter-moderated compaction.

Based on the above mechanism, determine the reasonable construction parameters, and impart the next 2 cycles of high vacuum and inter-moderated compaction.

Due to the vast treatment scope and the substantial soil data variation, the expected settlements vary between subsections. If no information-based measures are used to eliminate the settlement differences, site heaves are to occur and impede the site uses. For this project, to eliminate the railway differential settlement is the key.

In the above 5 steps, increase data (information) measurement and collection. Level the site using bulldozers after each cycle vacuum-compaction. Grid the site at 10×10 m and measure the elevation. Calculate the average settlement of each cycle vacuum-compaction. Compare the settlements with expected settlements. Impart the vacuum-compaction effort till the consistency between measured and expected settlements.

The initial design scheme using traditional soil improvement methods costs 23 million yuan and needs 90 days. Use of the information-based high vacuum densification method for fast treatment of soft soil of the present invention decreased the cost to 5 million yuan. Furthermore, 40 days were saved and quality was guaranteed. In addition, no construction aggregates were used which enhanced the environmental safety.

What is claimed is:

1. A method for treating soft soil, comprising:

(a) dividing a site into a plurality of subsections, investigating a profile of the soft soil in each of the plurality of subsections, and estimating expected settlement of the soft soil in each of the plurality of subsections;

(b) installing a plurality of water-tight systems around the site to block seepage of ambient groundwater from entering the site;

(c) installing a plurality of vacuum pipes in the plurality of subsections in a layered matrix form, connecting the plurality of vacuum pipes to a vacuum system via a plurality of ground horizontal pipes, placing a piezometer in each soil stratum, applying ramming energy thereto, and measuring pore water pressure dissipation of each soil stratum to determine the spacing of the plurality of vacuum pipes;

(d) performing a plurality of cycles of inter-moderated compactions in each of the plurality of subsections.

2. The method of claim 1, further comprising conducting subsurface consolidation after Step (b) and before Step (c), including installing a plurality of vacuum pipes into subsurface soil, conducting vacuuming while compacting the subsurface soil using a trailer, so as to decrease water contents of the subsurface soil and improve its bearing capacities.

3. The method of claim 1, further comprising eliminating differential settlements in step (d), including leveling the site using a bulldozer after each cycle of vacuum-compaction, calculating average settlement of each subsection, comparing the average settlement with an estimated value, and if the average settlement is inadequate, performing another cycle of vacuum-compaction till the estimated value is met.

4. The method of claim 1, wherein said vacuum-compactions include densification by dynamic or vibration compaction.

5. The method of claim 1, wherein each water-tight system includes a plurality of vacuum pipes installed at 2-3 m away around site, the vacuum pipes being connected to a ground horizontal vacuum system, so as to perform vacuum drainage during the treatment.

6. The method of claim 1, wherein the ramming energy ranges from 500~3500 kN·m.

* * * * *